US006982009B2

(12) United States Patent
Denda et al.

(10) Patent No.: US 6,982,009 B2
(45) Date of Patent: Jan. 3, 2006

(54) METHOD AND DEVICE FOR CLEANING ABRASIVE PLATES ON AN ABRASIVE MACHINE

(75) Inventors: Yasuhide Denda, Nagano (JP); Yoshio Nakamura, Nagano (JP); Yoshinobu Nishimoto, Nagano (JP); Makoto Nakajima, Nagano (JP); Tsuyoshi Hasegawa, Nagano (JP); Norihiko Moriya, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 10/937,830

(22) Filed: Sep. 9, 2004

(65) Prior Publication Data

US 2005/0034746 A1 Feb. 17, 2005

Related U.S. Application Data

(62) Division of application No. 09/992,191, filed on Nov. 6, 2001, now Pat. No. 6,807,701.

(30) Foreign Application Priority Data

Nov. 9, 2000 (JP) ..... 2000-341885

(51) Int. Cl.
*B08B 3/00* (2006.01)

(52) U.S. Cl. ..... 134/36; 134/34; 134/42; 134/199; 134/902; 15/44; 15/88.2; 15/102

(58) Field of Classification Search ..... 134/34, 134/42, 199, 902, 36; 15/44, 88.2, 102
See application file for complete search history.

(56) References Cited

FOREIGN PATENT DOCUMENTS

JP 9-309063 * 12/1997

* cited by examiner

*Primary Examiner*—Zeinab El-Arini
(74) *Attorney, Agent, or Firm*—Jordan and Hamburg LLP

(57) ABSTRACT

The method of the present invention cleans abrasive faces of an upper abrasive plate and a lower abrasive plate of an abrasive machine. The method is executed by a cleaning device including: a nozzle for jetting water; a brush for preventing the jetted water from scattering in the air, the brush enclosing the nozzle; and another brush for closing a gap between the preventing brush and an outer edge of the upper abrasive plate, the method is characterized by the steps of: jetting water from the nozzle toward the abrasive face of the upper abrasive plate; moving the nozzle toward the outer edge of the upper abrasive plate; and closing the gap by the closing brush when the gap is formed between the preventing brush and the outer edge of the upper abrasive plate.

8 Claims, 11 Drawing Sheets

METHOD AND DEVICE FOR CLEANING ABRASIVE PLATES ON AN ABRASIVE MACHINE

REFERENCE TO RELATED SPECIFICATION

This is a divisional application of application Ser. No. 09/992,191, filed Nov. 6, 2001, now U.S. Pat. No. 6,807,701.

BACKGROUND OF THE INVENTION

The present invention relates to a method of cleaning abrasive plates of an abrasive machine and a cleaning device, more precisely relates to a method, in which abrasive faces of an upper abrasive plates and a lower abrasive plates, which are mutually faced and rotated, are cleaned by water jetted from a nozzle moving along the abrasive faces, and a cleaning device executing said method.

Both side faces of a wafer-shaped work piece, e.g., silicon wafer, are abraded by an abrasive machine. A lapping machine, which is a kind of abrasive machines, is shown in FIG. 10.

In FIG. 10, the lapping machine has an upper abrasive plate 20, whose lower face is an abrasive face for lapping work pieces 10, e.g., silicon wafers, and keys 21 are keyed in an upper face of the upper abrasive plate 20. An air cylinder unit 22 is provided above the upper abrasive plate 20. The air cylinder unit 22 is fixed to an upper part of a gate-shaped frame 14. The upper abrasive plate 20 is rotatably connected to a lower end of a piston rod 22*a* of the air cylinder unit 22 by a rotary plate 23 and connecting rods 27. By employing a connector 22*b,* the piston rod 22*a* cannot rotate; the rotary plate 23 and the upper abrasive plate 20, which are connected by the connecting rods 27, can be rotated with respect to the piston rod 22*a* and held at the lower end thereof. With this structure, weight or a pressing force of the upper abrasive plate 20, which works to a lower abrasive plate 30, can be controlled by adjusting a lifting force of the cylinder unit 22.

Note that, in some cases, the pressing force working to the lower abrasive plate 30 is controlled by adjusting a pressing force applied to the upper abrasive plate 20.

Since the keys 21 engage with key grooves of a rotary member 54 which is rotated by a motor 70, the upper abrasive plate 20 is rotated by a driving force of the motor 70. A shaft 54*a* is downwardly extended from the rotary member 54. A gear 54*b,* which is fixed to a lower end of the shaft 54*a,* is engaged with an idle gear 63, and the idle gear 63 is engaged with a gear 64, which is fixed to a spindle 60. With this structure, the driving force or torque of the motor 70 can be transmitted to the upper abrasive plate 20 via the rotary member 54.

Since the upper abrasive plate 20 and the rotary member 54 are connected by the keys 21, a clearance between the upper abrasive plate 20 and the lower abrasive plate 30 can be made wider by actuating the air cylinder unit 22 when the work pieces 10 are set or discharged or maintenance is executed.

Carriers 40 are rotated by an external gear 50 and an internal gear 52. A first hollow shaft 50*a,* which is coaxial to the shaft 54*a,* is connected to the external gear 50, and a gear 50*b,* which is fixed to the first hollow shaft 50*a,* is engaged with a gear 65 of the spindle 60.

A second hollow shaft 30*a,* which is coaxial to the first hollow shaft 50*a,* is connected to the lower abrasive plate 30, and a gear 30*b,* which is fixed to a mid part of the second hollow shaft 30*a,* is engaged with a gear 61 of the spindle 60.

A third hollow shaft 52*a,* which is coaxial to the second hollow shaft 30*a,* is connected to the internal gear 52, and a gear 52*b,* which is fixed to the third hollow shaft 52*a,* is engaged with a gear 62 of the spindle 60. The spindle 60 is connected to an adjustable reduction unit 69, which is connected to the motor 70, e.g., an electric motor, a hydraulic motor, by a belt.

The upper abrasive plate 20, the lower abrasive plate 30, the external gear 50 and the internal gear 52 are rotated by one motor 70 via the reduction unit 69, the gears and the shafts.

An upper abrasive face of the lower abrasive plate 30 has discharging grooves 12 and 16, which run like lattice as shown in FIG. 11, so as to discharge abraded dusts, which are produced by abrading the work pieces 10, and slurry from the abrasive face. The discharging grooves 12 and 16 are formed in the lower abrasive face of the upper abrasive plate 20, too.

The abraded dusts and slurry gradually deposit in the discharging grooves 12 and 16, and they damage surfaces of the work pieces 10. To prevent the damage of the work pieces 10, the clearance between the abrasive plates 20 and 30 is widen by actuating the air cylinder unit 22 after a prescribed number of abrasive works are completed so as to clean the abrasive faces of the abrasive plates 20 and 30.

However, the abraded dusts and slurry are solidified in the grooves 12 and 16 of the abrasive faces of the abrasive plates 20 and 30, so they must be manually removed. Namely, a metal plate is manually inserted into the grooves 12 and 16 so as to scrape out the solidified dusts from the grooves 12 and 16. It takes a long time to completely clean the abrasive faces, and the abrasive faces are sometimes damaged.

To automatically clean the abrasive faces, a cleaning device was disclosed in the Japanese Patent Gazette No. 7-9342 (see FIG. 12). In the conventional cleaning device shown in FIG. 12, front end sections of two nozzles 100*a* and 100*b* are respectively enclosed by brush members 102. The nozzles 100*a* and 100*b* are provided to a front end of a shaft 106 and respectively headed upward and downward. With this structure, pressurized water is jetted upward and downward from the nozzles 100*a* and 100*b*. The shaft 106 is vertically and horizontally moved together with the nozzles 100*a* and 100 *b*.

In the cleaning device shown in FIG. 12, front ends of the brush members 102 simultaneously contact the abrasive faces of the upper abrasive plate 20 and the lower abrasive plate 30, and the pressurized water, whose pressure is about 50–100 atm., is simultaneously jetted from the nozzles 100*a* and 100*b* toward the abrasive faces rotating (see FIG. 13). The nozzles 100*a* and 100*b* are moved in the radial direction with respect to the abrasive faces, so that abraded dusts deposited in the grooves 12 and 16 of the abrasive faces can be removed.

The cleaning device shown in FIGS. 12 and 13 can automatically clean the abrasive faces of the abrasive plates 20 and 30.

When the pressurized water is jetted from the nozzles 100*a* and 100*b* toward the abrasive faces, the nozzles 100*a* and 100*b* are respectively formed by the brush members 102 and the abrasive faces, so that the jetted water cannot be scattered outside.

However, outer edges of the abrasive plates 20 and 30 must be washed so as to clean the whole abrasive faces. When the nozzles 100*a* and 100*b* are moved to the outer edged of the abrasive plates 20 and 30, gaps are respectively formed between the outer edges of the abrasive plates 20 and 30 and the brush members 102 as shown in FIG. 14, so that the jetted water is scattered outside from the gaps.

The water jetted outside from the gap between the outer edge of the lower abrasive plate 30 and the brush member 102 for cleaning the lower abrasive plate 30 is received and introduced outside of the cleaning device via a discharging section 31*a* (see FIG. 10). The discharging section 31*a* is formed along the outer edge of the lower abrasive plate 30. As shown in FIG. 10, the internal gear 52 is provided in the discharging section 31*a,* so a width of the discharging section 31*a* is narrow. Therefore, the water, which has once passed through the discharging section 31*a,* is not returned to the abrasive face via the discharging section 31*a*.

On the other hand, the water jetted outside from the gap between the outer edge of the upper abrasive plate 20 and the brush member 102 for cleaning the upper abrasive plate 20 is scattered into a space, in which an abrading mechanism is set.

The water, which is scattered into the space, includes the abraded dusts and used slurry, so it makes abraded products dirty.

Especially, the abrasive machine for abrading silicon wafers, is located in a clean room, so the water jetted from the nozzle 100*a* and scattered into the clean room via the gap of the upper abrasive plate 20 makes degree of cleanliness of the clean room lower.

If a moving range of the nozzles 100*a* and 100*b* is limited so as to prevent the water jetted from the nozzle 100*a* from scattering outside via the gap of the upper abrasive plate 20, the outer edge portions of the abrasive faces of the abrasive plates 20 and 30 cannot be cleaned, and the portions must be manually cleaned. Therefore, it is difficult to automatically clean the whole abrasive faces of the abrasive plates 20 and 30.

Further, in the cleaning device shown in FIGS. 12 and 13, the pressurized water is simultaneously jetted from the nozzles 100*a* and 100*b* so as to simultaneously wash the abrasive faces of the abrasive plates 20 and 30. Therefore, the water washing the lower abrasive face of the upper abrasive plate 20 falls onto the upper abrasive face of the lower abrasive plate 30, so that the upper abrasive face of the lower abrasive plate 30 is made dirty again by the water washing the lower abrasive face of the upper abrasive plate 20.

In the case that width and density of the discharging grooves 12 and 16 of the upper abrasive plate 20 are different from those of the lower abrasive plate 30, proper moving speed for washing the upper abrasive plate 20 is different from that for washing the lower abrasive plate 30. In the cleaning device shown in FIGS. 12 and 13, the moving speed of the both nozzles 100*a* and 100*b* are equal, so one of the abrasive faces cannot be cleaned properly.

SUMMARY OF THE INVENTION

A first object of the present invention is to provide a method of cleaning abrasive plates, which is capable of cleaning whole abrasive faces of an upper abrasive plate and a lower abrasive plate without scattering jetted water into a space in which an abrading mechanism is set, and a cleaning device for executing said method.

A second object is provide to a method of cleaning abrasive plates, which is capable of cleaning the abrasive faces of the both abrasive plates rotating, which are mutually faced, without making the upper abrasive face of the lower abrasive plate dirty with water washing the lower abrasive face of the lower abrasive plate, and a cleaning device for executing said method.

To achieve the first object, the inventors of the present invention studied and found that scattering the jetted water into the space in which an abrading mechanism is set can be prevented by the steps of: moving a nozzle, which jets pressurized water and which is formed by a brush and the abrasive face of the upper abrasive plate, toward an outer edge of the upper abrasive plate; and closing a gap between the outer edge of the upper abrasive plate and the brush by another brush when the gap is formed.

Namely, the first object can be achieved by the following method. It is a method of cleaning abrasive faces of an upper abrasive plate and a lower abrasive plate of an abrasive machine, which are mutually faced, by a cleaning device including:

a nozzle for jetting water toward the abrasive faces of the abrasive plates rotating;

means for moving the nozzle along the abrasive faces;

means for preventing the jetted water from scattering in the air, the preventing means enclosing the nozzle; and means for closing a gap between the preventing means and an outer edge of the upper abrasive plate, the method is characterized by the steps of:

jetting water from the nozzle toward the abrasive face of the upper abrasive plate;

moving the nozzle toward the outer edge of the upper abrasive plate; and closing the gap by the closing means when the gap is formed between the preventing means and the outer edge of the upper abrasive plate.

In this method, as described in BACKGROUND OF THE INVENTION, the jetted water for cleaning the abrasive face of the lower abrasive plate is not scattered into a space, in which an abrading mechanism is set, even if the jetted water is jetted from the gap between the preventing means and the outer edge of the lower abrasive plate.

Therefore, if no water is jetted outside from the gap between the preventing means and the outer edge of the upper abrasive plate while cleaning the upper abrasive plate, the whole abrasive faces of the both abrasive plates can be cleaned without scattering water into the space in which the abrading mechanism is set.

In the method of the present invention, the nozzle, which jets the water toward the abrasive face of the upper abrasive plate and which is formed by the abrasive face of the upper abrasive plate and the preventing means, is moved toward the outer edge of the upper abrasive plate, and the closing means closes the gap between the preventing means and the outer edge of the upper abrasive plate.

With this action, the whole abrasive faces of the both abrasive plates can be cleaned without scattering water into the space in which the abrading mechanism is set.

To achieve the second object, the inventors of the present invention studied and found that contamination of the abrasive face of the lower abrasive plate can be prevented by the steps of: washing the lower abrasive face of the upper abrasive plate; and secondly washing the upper abrasive face of the lower abrasive plate after the upper abrasive plate is washed, whereby the water washing the upper abrasive plate can be securely removed when the lower abrasive plate is washed.

The second object can be achieved by the following method. It is a method of cleaning abrasive faces of an upper abrasive plate and a lower abrasive plate of an abrasive machine, which are mutually faced, by a cleaning device including:

a pivotable nozzle for jetting water toward the abrasive faces of the abrasive plates rotating;

means for pivoting the nozzle; and means for moving the nozzle along the abrasive faces, the method is characterized by the steps of:

jetting water from the nozzle toward the abrasive face of the upper abrasive plate;

moving the nozzle so as to clean the abrasive face of the upper abrasive plate;

pivoting the nozzle toward the abrasive face of the lower abrasive plate;

jetting water from the nozzle toward the abrasive face of the lower abrasive plate; and moving the nozzle so as to clean the abrasive face of the lower abrasive plate.

In this method, firstly the lower abrasive face of the upper abrasive plate is cleaned by the water jetted from the nozzle. Then, the nozzle is pivoted toward the upper abrasive face of the lower abrasive plate, and the upper abrasive face of the lower abrasive plate is cleaned by the jetted water. With this action, the water washing the upper abrasive plate and falling onto the upper abrasive face of the lower abrasive plate can be securely removed when the lower abrasive plate is washed, so that the contamination of the lower abrasive plate can be fully prevented.

Further, in this method, width and density of discharging grooves, which discharge abraded dusts and slurry outside, of the upper abrasive plate may be different from those of the lower abrasive plate, and moving speed of the nozzle for cleaning the abrasive face of the upper abrasive plate and that for cleaning the abrasive face of the lower abrasive plate may be independently controlled.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
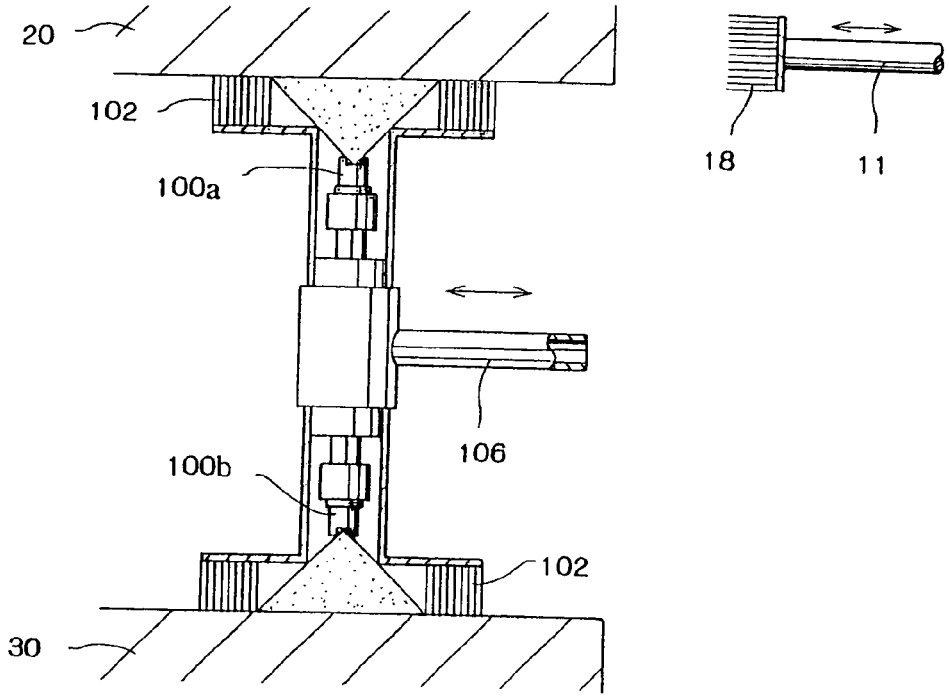
FIG. 1 is a partial sectional view of an embodiment of a cleaning device of the present invention.
Figure 12:
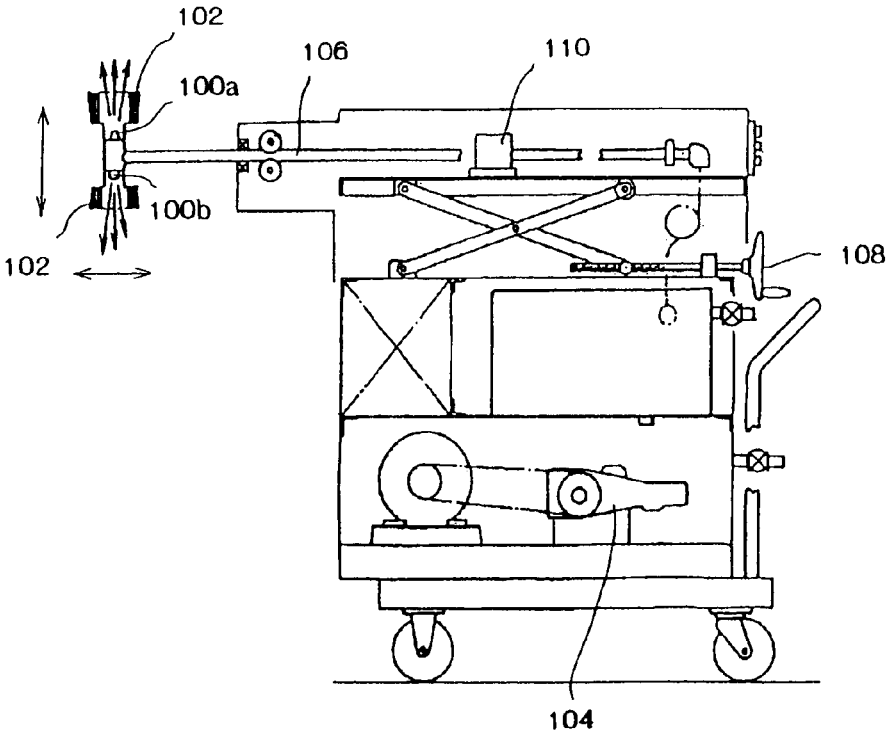
FIG.12 PRIOR ART
FIG. 12 is an explanation view of a conventional cleaning device.
Figure 13:
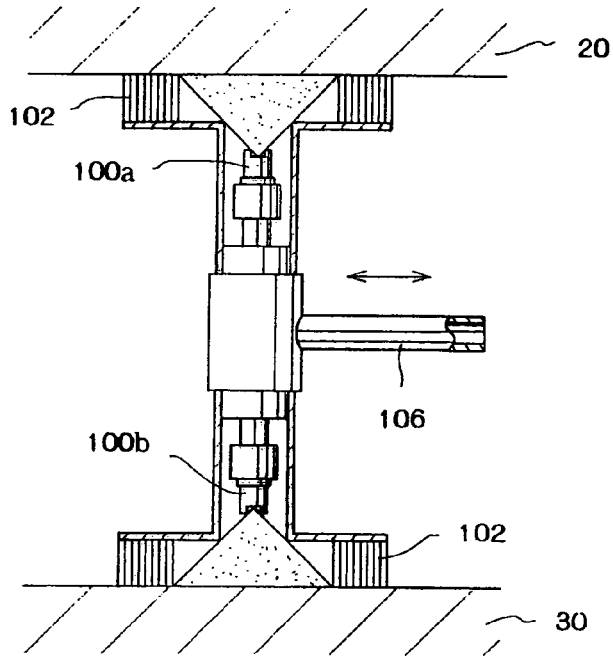
FIG.13 PRIOR ART
FIG. 13 is an explanation view of a nozzle section of the conventional cleaning device shown in FIG. 12.
Figure 14:
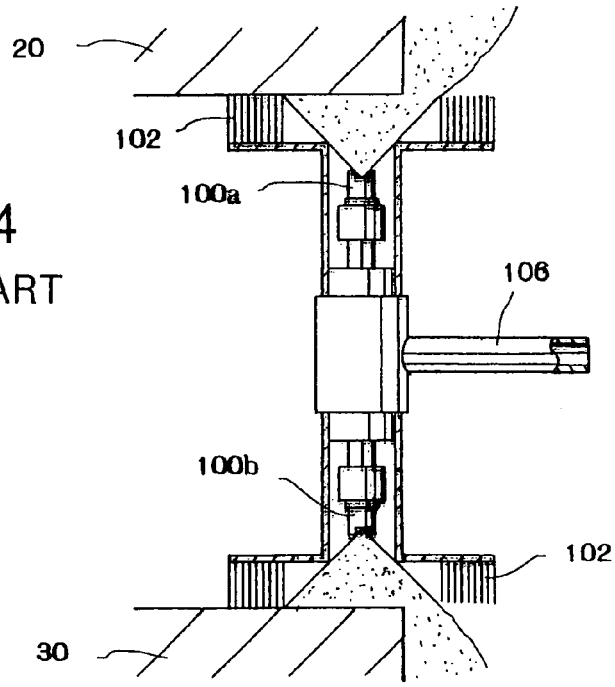
FIG.14 PRIOR ART
FIG. 14 is an explanation view showing a state, in which the nozzle section shown in FIG. 13 is located in the vicinity of outer edges of abrasive plates.

An embodiment of the cleaning device of the present invention is shown in FIG. 1. In the cleaning device shown in FIG. 1, two nozzles 100*a* and 100*b*, each of which is enclosed by a brush 102 for preventing jetted water from scattering in air, are respectively provided to an upper end and a lower end of a shaft 106, which is extended along abrasive faces of an upper abrasive plate 20 and a lower abrasive plate 30, and the water, which is pressurized and supplied by a high pressure pump 104, is upwardly and downwardly jetted from the nozzles 100*a* and 100*b* as well as the conventional cleaning device shown in FIG. 12.

Front ends of the brushes 102, which respectively enclose the nozzles 100*a* and 100*b*, contact and wash the abrasive faces of the abrasive plates 20 and 30. Each of the brushes 102 forms a space, which defines a range of scattering water jetted from the nozzle 100*a* or 100*b*, with the abrasive face. Since the water can flow out from the brushes 102, no water is stored in the brushes 102.

The shaft 106, to which the nozzles 100*a* and 100*b* are provided, can be vertically moved by elevating means, e.g., a handle 108; the shaft 106 can be horizontally moved by moving means, e.g., a motor 110.

The cleaning device shown in FIG. 1 is capable of cleaning the abrasive faces of the abrasive plates 20 and 30. The cleaning device shown in FIG. 1 inserts the brushes 102 into a space between the abrasive faces of the rotating abrasive plates 20 and 30, which are mutually faced. The ends of the brushes 102 simultaneously contact the abrasive faces, and the pressurized water, whose pressure is about 50–100 atm., is jetted toward the abrasive faces from the nozzles 100*a* and 100*b*, which are also inserted in the space together with the brushes 102. The nozzles 100*a* and 100*b* jetting the water are moved along the abrasive faces so as to remove abraded dusts, etc. deposited in discharging grooves 12 and 16 of the abrasive faces.

When the abrasive faces of the abrasive plates 20 and 30 are cleaned, the nozzles 100*a* and 100*b* are respectively located in spaces, each of which is formed by the brush 102 and the abrasive face to be cleaned, so that the nozzles 100*a* and 100*b* jet the water in the spaces without scattering the water outside.

The cleaning device shown in FIG. 1 has a shaft 11 and the brush 18, which is provided to a front end of the shaft 11. The brush 18 can move to and away from the upper abrasive plate 20. The brush. 18 can contact an outer circumferential face of the upper abrasive plate 20.

Figure 2:
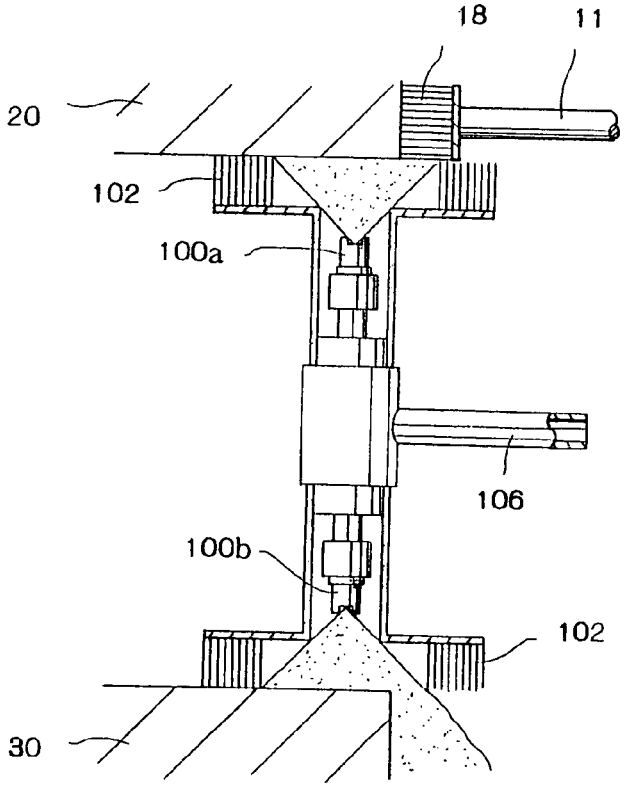
FIG. 2 is an explanation view of the cleaning device shown in FIG. 1.

The brush 18 is used as closing means as shown in FIG. 2. When the edge portions of the abrasive plates 20 and 30 are cleaned, the nozzles 100*a* and 100*b* are moved to the outer edges of the abrasive plates 20 and 30. Then gaps are formed between the outer edges of the abrasive plates 20 and 30 and inner edges of the brushes 102.

The gap between the outer edges of the abrasive plate 20 and the inner edge of the brush 102 for cleaning the upper abrasive plate 20 is closed by the brush 18. With this action, the water jetted from the nozzle 100*a* is not scattered outside.

On the other hand, the water jetted from the nozzle 100*b* can be discharged from the gap between the outer edges of the abrasive plate 30 and the inner edge of the brush 102 for cleaning the abrasive plate 30.

Figure 10:
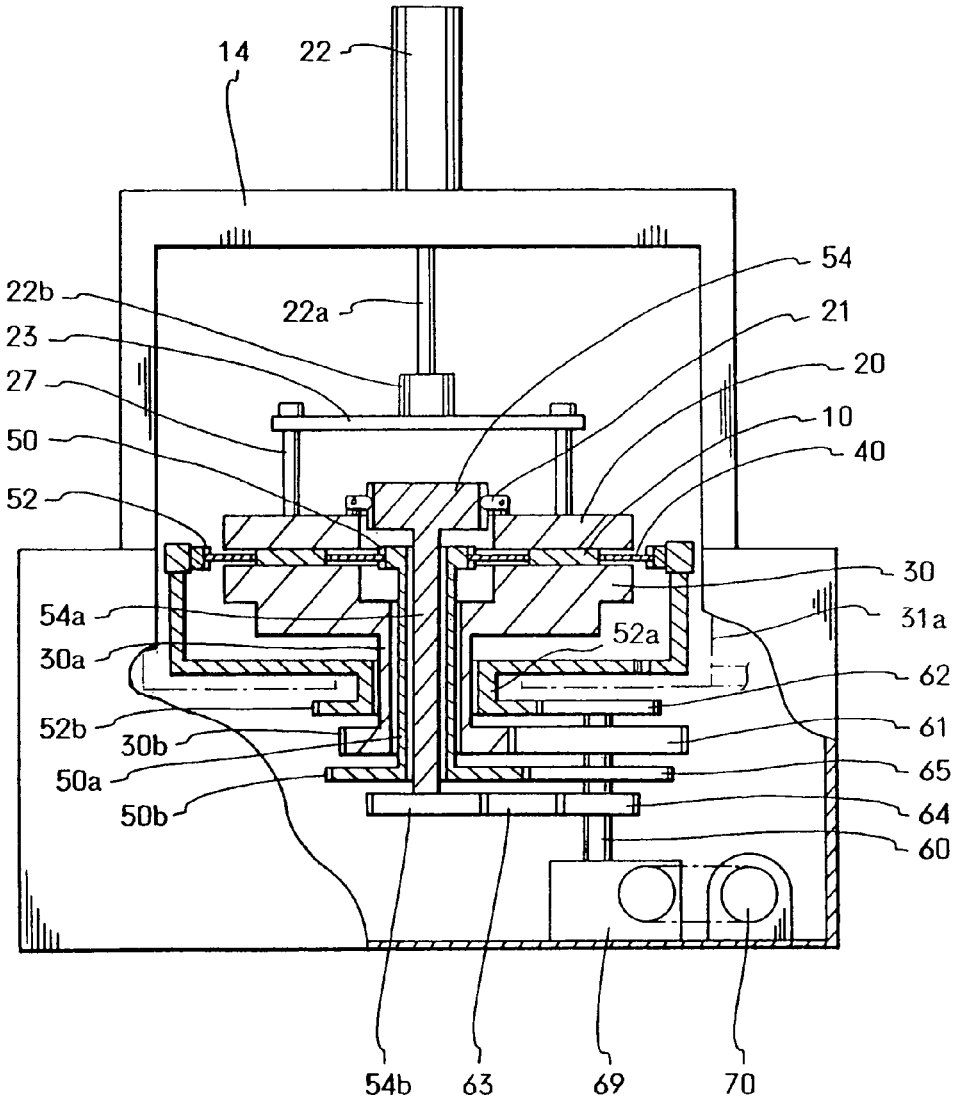
FIG. 10 is an explanation view of a lapping machine, which is an example of the abrasive machines.

When the abrasive face of the lower abrasive plate 30 is cleaned by the water jetted from the nozzle 100*b* of the cleaning device shown in FIG. 1, the water jetted outside from the gap between the outer edge of the lower abrasive plate 30 and the brush member 102 for cleaning the lower abrasive plate 30 is received and introduced outside of the cleaning device via the discharging section 31*a* (see FIG. 10) as shown in FIG. 2. The discharging section 31*a* is formed and opened along the outer edge of the lower abrasive plate 30 so as to discharge slurry, etc. outside. As shown in FIG. 10, the internal gear 52 is provided in the discharging section 31*a*, so the width of the discharging section 31*a* is narrow. Therefore, the water, which has once passed through the discharging section 31*a*, is not returned to the abrasive face via the discharging section 31*a*.

In the cleaning device shown in FIGS. 1 and 2, the whole abrasive faces of the both abrasive plates 20 and 30 of the abrasive machine, by the water jetted from the nozzles 100*a* and 100*b*, without scattering the water into a space, in which the abrading mechanism is set.

In the cleaning device shown in FIGS. 1 and 2, the whole abrasive faces of the both abrasive plates 20 and 30 are simultaneously cleaned, so the water which has cleaned the lower abrasive face of the upper abrasive plate 20 falls onto and contaminates the upper abrasive face of the lower abrasive plate 30.

If width and density of the discharging grooves 12 and 16 of the upper abrasive plate 20 are different from those of the lower abrasive plate 30, proper moving speed for cleaning the upper abrasive plate 20 is different from that for cleaning the lower abrasive plate 30. Then, if the moving speed of the both nozzles 100*a* and 100*b* are equal, one of the abrasive faces cannot be cleaned properly.

Figure 3:
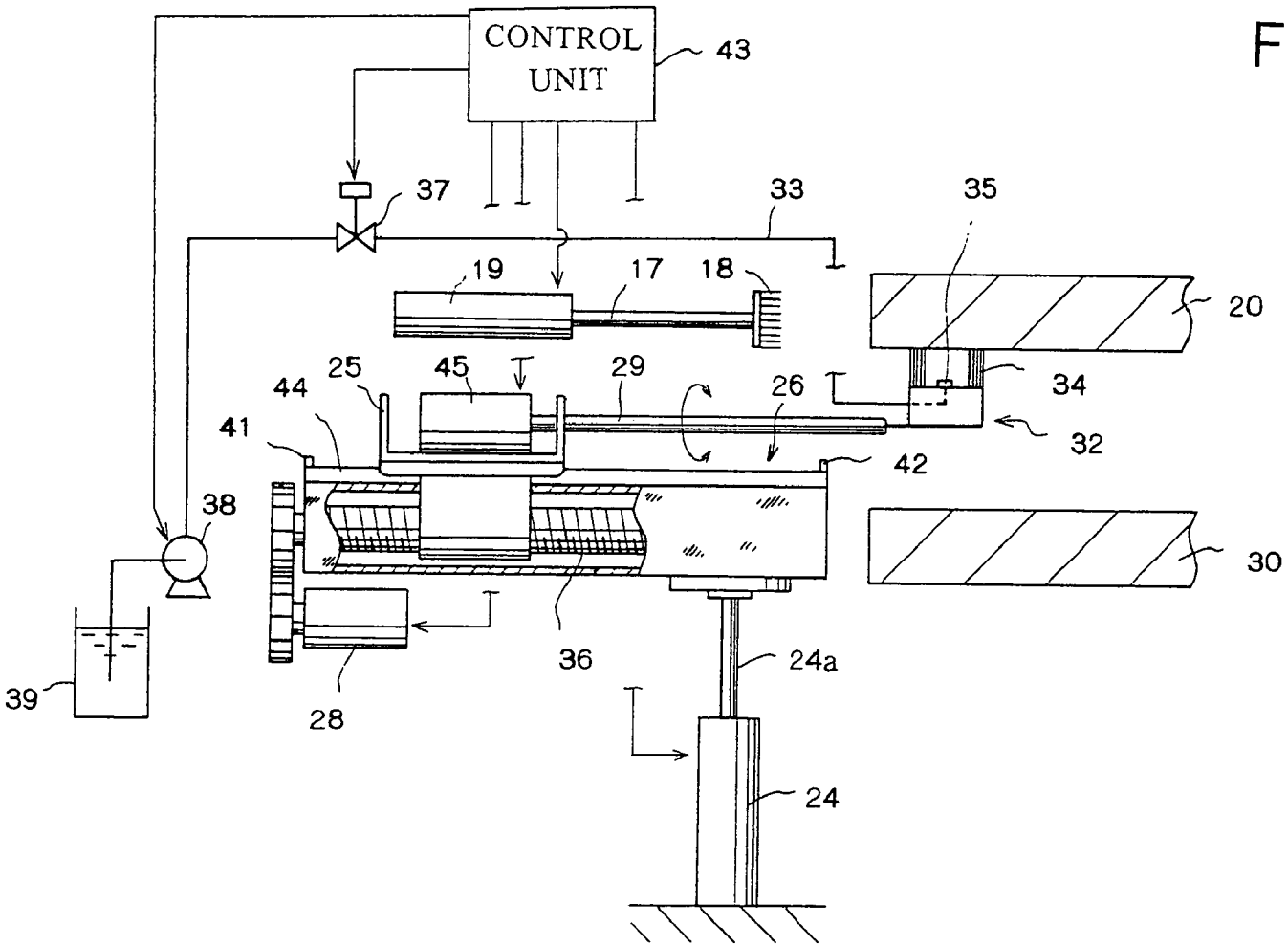
FIG. 3 is an explanation view of another embodiment of the cleaning device.

The contamination of the lower abrasive plate 30 can be prevented by a cleaning device shown in FIG. 3.

The cleaning device shown in FIG. 3 includes: an air cylinder unit 24 having a piston rod 24*a* for vertically moving a moving unit 26; a pump 38 for supplying the pressurized water to a nozzle section 32; and a tank 39 for supplying water to the pump 38.

The moving unit 26 includes: a casing; a motor 28; and a ball bearing screw 36, which is rotated in a normal direction and a reverse direction by the motor 28. By rotating the ball bearing screw 36 by the motor 28, a moving body 25 is moved along a rail 44, which is fixed on an upper face of the casing. A shaft 29 is rotatably connected to the motor 45, which is mounted on the moving body 25, and extended along the abrasive faces of the abrasive plates 20 and 30. The nozzle section 32 is provided to a front end of the shaft 29.

With this structure, the nozzle section 32 can be moved along the abrasive faces of the abrasive plates 20 and 30 with the movement of the moving body 25. Further, by actuating the motor 45 to turn the nozzle section 32, the nozzle section 32 is capable of heading to and jetting the water toward the abrasive face of the upper abrasive plate 20 or the abrasive face of the lower abrasive plate 30.

To detect stroke ends of the movement of the moving body 25, position detecting sensors 41 and 42, e.g., photo sensors, are respectively provided to ends of the rail 44.

A nozzle 35 is included in the nozzle section 32, which is fixed to the front end of the shaft 29. The water is introduced from the pump 38 to the nozzle 35 via a pipe 33. The nozzle 35 is enclosed by a brush 34. Front end of the brush 34 is capable of contacting the abrasive face of the abrasive plate 20 or 30 to wash the abrasive face. Further, the brush 34 defines a range of scattering the water jetted from the nozzle 35. Since the water can flow out from the brushes 34, no water is stored in a space enclosed by the brush 34.

A control valve 37, e.g., an electromagnetic valve, is provided to a mid part of the pipe 33 so as to control water supply to the nozzle 35.

A shaft 17 is extended and retracted by an air cylinder unit 19, and the brush 18 is provided to a front end of the shaft 17. By actuating the air cylinder unit 19, the brush 18 can be moved to and away from the outer circumferential face of the upper abrasive plate 20.

The motors 28 and 45 of the moving unit 28, the pump 38,the air cylinder units 19 and 24, and the control valve 37 are controlled by a control unit 43.

In the case of cleaning the abrasive faces of the abrasive plates 20 and 30 of the lapping machine shown in FIG. 10, firstly the cylinder unit 22 of the lapping machine is actuated so as to upwardly move the upper abrasive plate 20 and widen the clearance between the abrasive plates 20 and 30, which are not rotated.

Then, the control unit 43 drives the motors 28 and 45 and actuates the cylinder unit 24 so as to insert the nozzle section 32 into the wide clearance between the abrasive plates 20 and 30 and turn the nozzle section 32 to head to the lower abrasive face of the upper abrasive plate 20. With this action, the water can be jetted toward the lower abrasive face of the upper abrasive plate 20.

Successively, the abrasive plates 20 and 30 are rotated, and the water is jetted toward the lower abrasive face of the rotating upper abrasive plate 20, so that the lower abrasive face of the upper abrasive plate 20 can be cleaned. After the lower abrasive face of the upper abrasive plate 20 is cleaned, the nozzle section 32 is turned to head to the upper abrasive face of the lower abrasive plate 30.

Then, the upper abrasive face of the lower abrasive plate 30 is cleaned by the water jetted from the nozzle 35.

When the abrasive face of the rotating upper abrasive plate 20 is cleaned, the control unit 43 drives the motor 28 of the moving unit 26 and actuates the cylinder unit 24 so as to make the brush 34 of the nozzle section 32 contact the outer edge part of the rotating upper abrasive plate 20. Then, the control unit 43 drives the pump 38 and opens the valve 37 so as to jet the water from the nozzle 35 toward the abrasive face of the upper abrasive plate 20. Proper temperature of the water for easily wash the abrasive face is 10–90° C., preferably about 40° C.; proper pressure of the jetted water at an outlet of the pump 38 is 10.79 MPa or more, preferably 11.76 MPa or more.

Note that, amount of jetting water can be reduced by increasing water pressure.

While the nozzle section 32 cleans the abrasive face of the upper abrasive plate 20, the control unit 43 drives the motor 28 so as to move the nozzle section 32 jetting the water from the outer edge portion of the upper abrasive plate 20 toward the center thereof.

When the nozzle section 32 reaches the center, the control unit 43 drives the motor 28 so as to move the nozzle section 32, whose brush 34 is contacting the abrasive face of the upper abrasive plate 20 and whose nozzle 35 is jetting the water thereto, toward the outer edge of the upper abrasive plate 20.

When the nozzle section 32 approaches to the outer edge of the upper abrasive plate 20, a gap is formed between the outer edge of the upper abrasive plate 20 and an inner edge of the brush 34. At that time, the control unit 43 actuates the cylinder unit 19 so as to make the brush 18 contacts the outer circumferential face of the upper abrasive plate 20 and close the gap (see FIG. 2).

After the contact, the nozzle section 32 is moved from the outer edge portion of the upper abrasive plate 20 to the center thereof. When the gap between the outer edge of the upper abrasive plate 20 and the brush 34 is disappeared, the control unit 43 actuates the cylinder unit 10 so as to leave the brush 18 from the outer circumferential face of the upper abrasive plate 20.

Since the nozzle section 32, whose brush 34 is contacting the abrasive face of the upper abrasive plate 20 and whose nozzle 35 is jetting the water thereto, is reciprocatively moved along the abrasive face of the upper abrasive plate 20, the whole abrasive face of the upper abrasive plate 20 can be cleaned.

Proper time for cleaning the abrasive face of the abrasive plate 20 was previously known by experiments, and it is inputted to a timer. When the set time elapsed, cleaning of the upper abrasive plate 20 is completed.

Note that, the control unit 43 can know if the nozzle section 32 reaches the outer edge or the center of the upper abrasive plate 20 by signals from the sensors 41 and 42.

When the control unit 43 receives a signal from the timer which indicates the termination of the cleaning of the upper abrasive plate 20, the control unit 43 stops the pump 38 and closed the valve 37, then drives the motor 45 so as to turn and head the nozzle section 32 to the upper abrasive face of the lower abrasive plate 30.

When the brush 34 of the nozzle section 32 contacts an outer edge portion of the lower abrasive plate 30, the control unit 43 drives the pump 38 and opens the valve 37, so that the water is jetted from the nozzle 35 toward the abrasive face of the lower abrasive plate 30 so as to clean the abrasive face of the lower abrasive plate 30.

As well as the abrasive face of the upper abrasive plate 20, the abrasive face of the lower abrasive plate 30 is cleaned by controlling the motor 28 so as to reciprocatively move the nozzle section 32, whose brush 34 is contacting the abrasive face of the lower abrasive plate 30 and whose nozzle 35 is jetting the water thereto, between the outer edge of the lower abrasive plate 30 and the center thereof.

As described above, when the lower abrasive pate 30 is cleaned, the water, which has once passed through the discharging section 31*a* (see FIG. 10), is not returned to the abrasive face of the lower abrasive plate 30. Therefore, means for closing a gap between the outer edge of the lower abrasive plate 30 and the inner edge of the brush 34 is not required, but the closing means may be provided for the lower abrasive plate 30.

Figure 11:
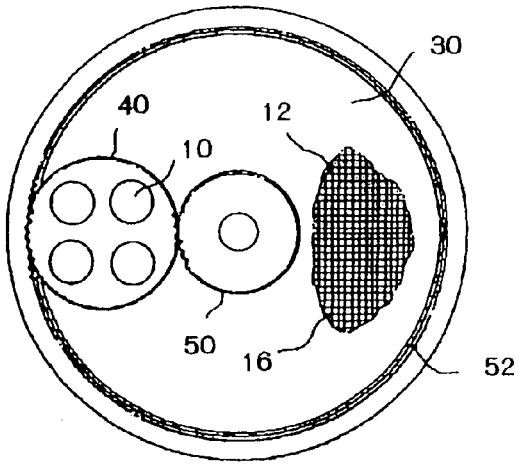
FIG. 11 is a partial plan view of an abrasive face of a lower abrasive plate of the lapping machine shown in FIG. 10.

Preferably, the moving speed of the nozzle 35 for cleaning the upper abrasive plate 20 and that for cleaning the lower abrasive plate 30 are independently defined so as to properly remove abraded dusts deposited in the grooves 12 and 16 (see FIG. 11) of the abrasive faces. The proper speed for the abrasive plates 20 and 30 were respectively known by experiments and stored in the control unit 43.

Since the proper moving speed of the nozzle section 32 depends on the width and density of the discharging grooves 12 and 16 of each abrasive face, the moving speed for cleaning the upper abrasive plate 20 and the lower abrasive plate 30 were previously defined on the basis of experiments and stored in the control unit 43.

By reciprocatively moving the nozzle section 32, whose brush 34 is contacting the abrasive face of the lower abrasive plate 30 and whose nozzle 35 is jetting the water thereto, the whole abrasive face of the lower abrasive plate 30 can be cleaned. While moving the nozzle section 32, the abraded dusts can be removed from the abrasive face of the lower abrasive plate 30. Further, the water, which has washed the abrasive face of the upper abrasive plate 20 and fallen onto the abrasive face of the lower abrasive plate 30, also can be removed, so that the contamination of the lower abrasive plate 30 can be securely prevented.

Proper time for cleaning the abrasive face of the lower abrasive plate 30 was also previously known by experiments, and it is inputted to the timer. When the set time elapsed, cleaning of the lower abrasive plate 30 is completed.

When the control unit 43 receives a signal from the timer which indicates the termination of the cleaning of the lower abrasive plate 30, the control unit 43 stops the pump 38 and closed the valve 37.

After the cleaning of the abrasive faces of the both abrasive plates 20 and 30 are completed, the nozzle section 32 is moved out from the clearance between the abrasive plates 20 and 30.

The moving speed of the nozzle section 32 may be fixed. And, the moving speed may be varied on the basis of area of cleaning the abrasive face and peripheral speed of the abrasive plates 20 and 30. For example, the cleaning area of the outer edge portion of the abrasive face is broader than that of the center portion thereof, and the peripheral speed of the outer edge portion is higher than that of the center portion. Therefore, the moving speed of the nozzle section 32 for cleaning the outer edge portion may be lower than that for cleaning the center portion so as to make the cleaning area in the outer edge portion broader.

Figure 4A:
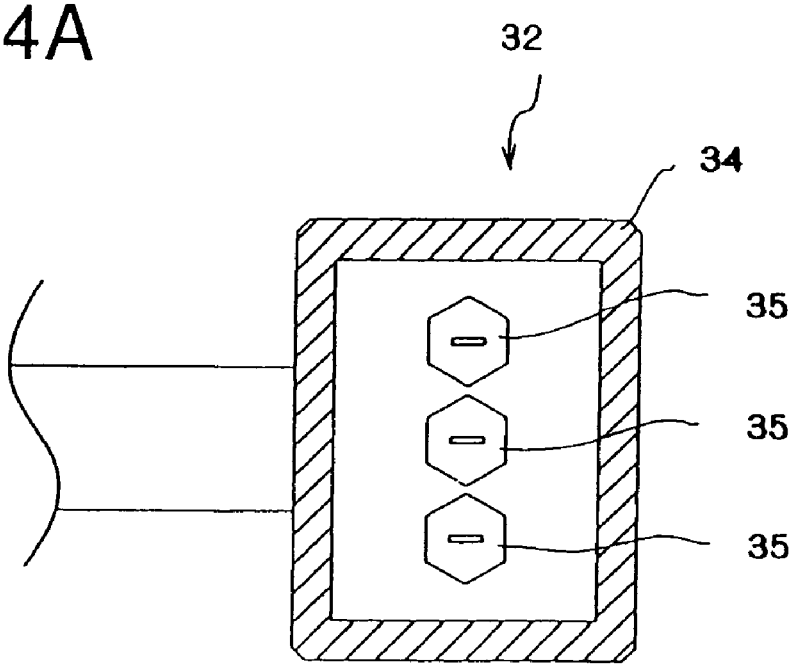
FIGS. 4A and 4B are partial front views of another nozzle of the cleaning device shown in FIG. 3.
Figure 4B:
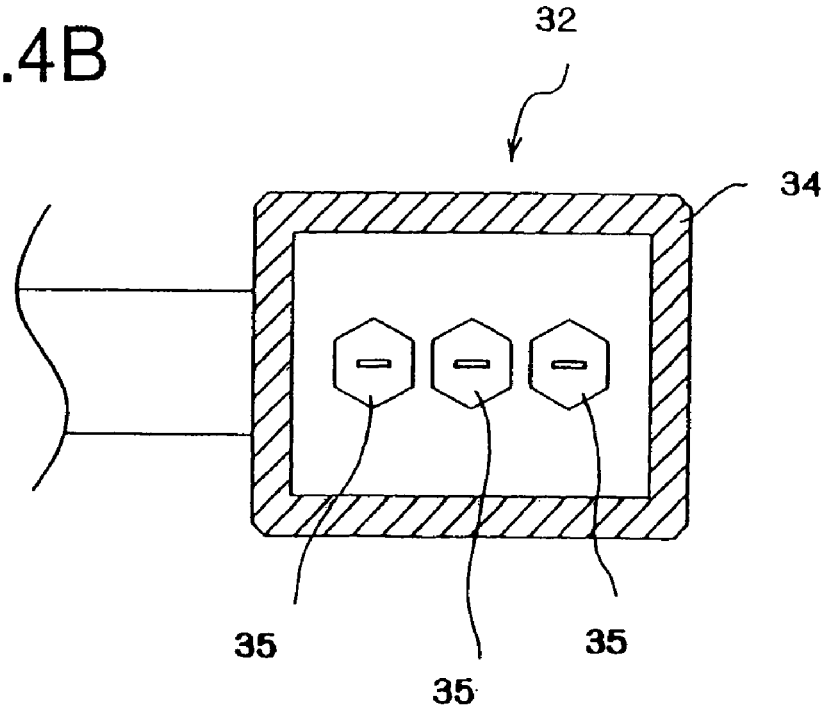

The nozzle section 32 shown in FIG. 3 has one nozzle 35. To shorten the time for cleaning the abrasive faces of the both abrasive plates 20 and 30, a plurality of the nozzles 35 may be provided as shown in FIGS. 4A and 4B. A plurality of the nozzles 35 may be arranged parallel in the direction of moving the nozzle section 32(see FIG. 4A) or serially arranged in said direction (see FIG. 4B).

Further, all or some of the nozzles 35 may jet the water with supersonic waves. In this case, for example, some nozzles 35 jets the high pressure water, whose pressure at the outlet of the pump 38 is 10.79 MPa or more; other nozzles 35 jets low pressure water, whose pressure at the outlet of the pump 38 is less than 10.79 MPa, and irradiate supersonic waves toward the low pressure water. By using the high pressure water and the low pressure water to which the supersonic waves are irradiated, the abraded dusts deposited in the grooves 12 and 16 can be broken by the supersonic waves, and they can be scraped out by the high pressure water.

Note that, some of the nozzles 35 may jet a liquid including an anticorrosive agent.

Figure 5:
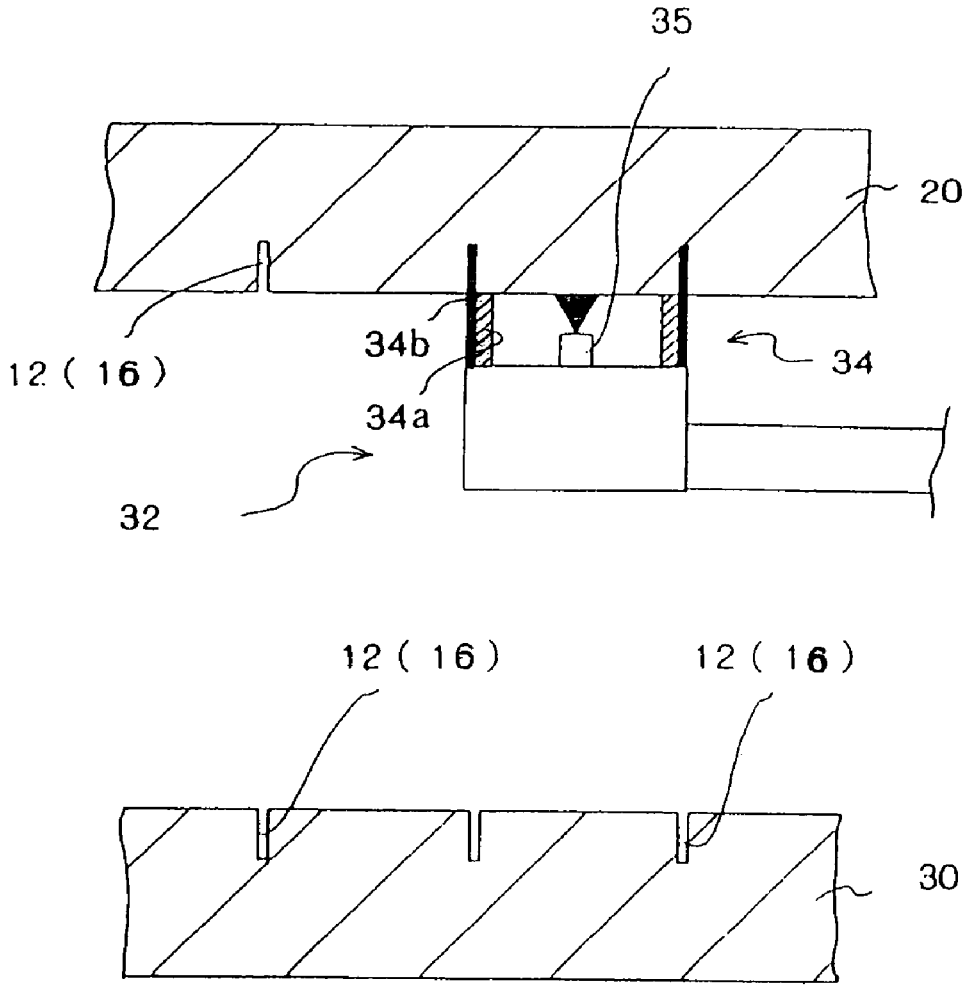
FIG. 5 is a partial front view of another nozzle of the cleaning device shown in FIG. 3.

In the cleaning device shown in FIGS. 3–4B, length of hairs of the brush 34, which encloses the nozzle 35, are fixed, but the length of the hairs of the brush 34 may be varied as shown in FIG. 5. The brush 34 shown in FIG. 5 has a dual structure including an inner brush 34*a* and an outer brush 34*b*. The length of hairs of the inner brush 34*a* is shorter than that of the outer brush 34*b*. In FIG. 5, the short inner brush 34*a* contacts and cleans the abrasive face of the upper abrasive plate 20; the long outer brush 34*b* enters and cleans the grooves 12 and 16 of the abrasive face.

Figure 6:
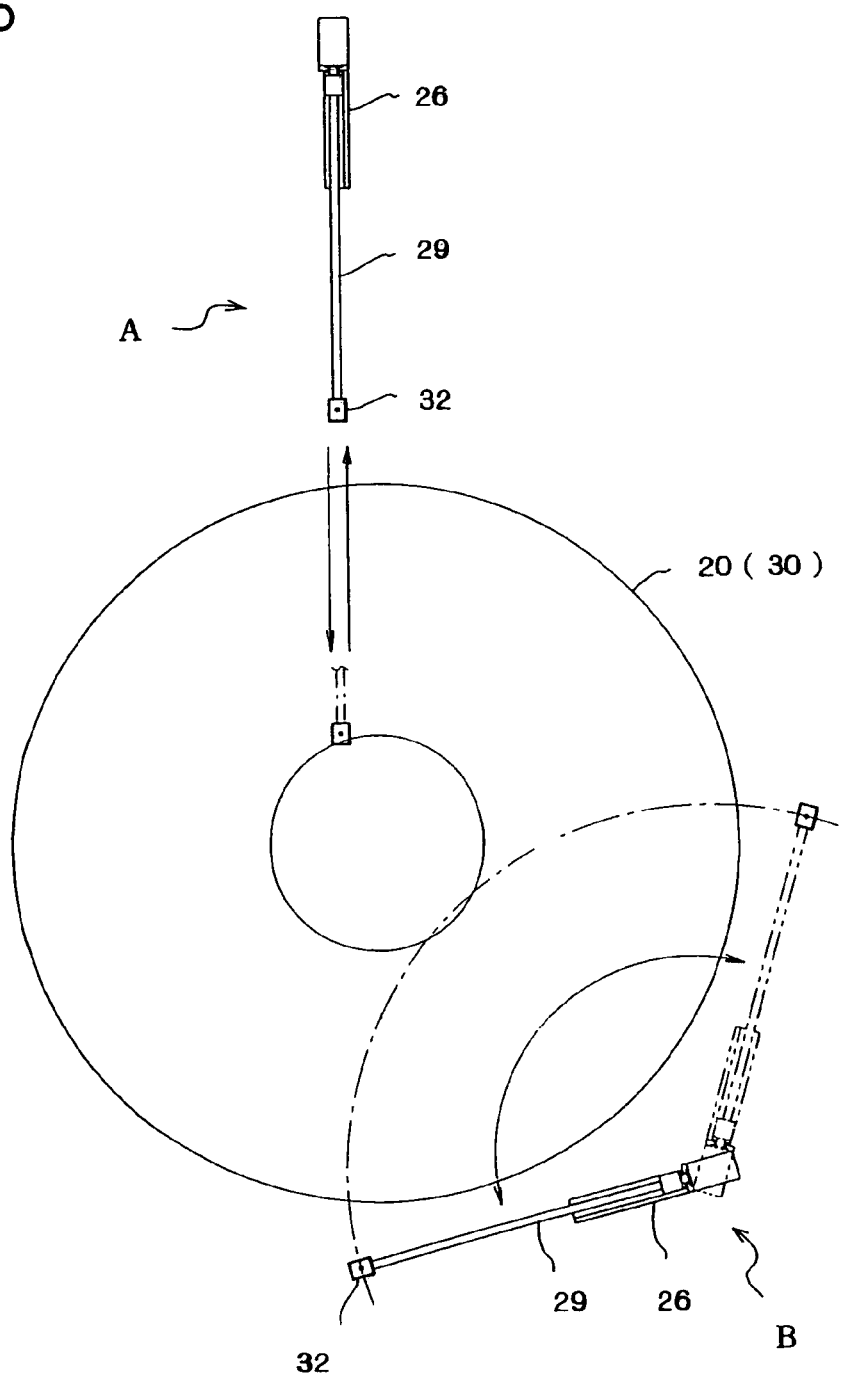
FIG. 6 is an explanation view showing moving directions of the nozzle shown in FIG. 3.

In the cleaning device shown in FIGS. 3–5, the nozzle section 32 is linearly moved between the outer edge and the center of the abrasive plate. In FIG. 6, this structure is shown as the device "A". On the other hand, the nozzle section 32 may be turned with respect to the abrasive plate. The turnable device "B" is also shown in FIG. 6. Of course, the both devices "A" and "B" may be combined.

In the cleaning device shown in FIGS. 1 and 2 too, the abrasive face of the lower abrasive plate 30 can be cleaned after the abrasive face of the upper abrasive plate 20 is cleaned as well as the cleaning device shown in FIGS. 3–5. In this case, for example, two pipes for supplying the water are connected to each of the nozzles 100*a* and 100*b*, and a control valve, e.g., an electromagnetic valve, is provided to each pipe. The control valves may be controlled by a control unit. The control unit opens the valve for supplying the water to the nozzle 100*a* so as to clean the abrasive face of the upper abrasive plate 20. After the upper abrasive plate 20 is cleaned, the control unit opens the valve for supplying the water to the nozzle 100*b* so as to clean the abrasive face of the lower abrasive plate 30.

In the cleaning device shown in FIGS. 3–6, the nozzle 35 firstly cleans the lower abrasive face of the upper abrasive plate 20, then the nozzle 35 is turned to clean the upper abrasive face of the lower abrasive plate 30. With this structure, working efficiency of the cleaning device shown in FIGS. 3–6 is lower than that of the cleaning device shown in FIGS. 1 and 2, which is capable of simultaneously jetting the water from the nozzles 100*a* and 100*b*.

Figure 7A:
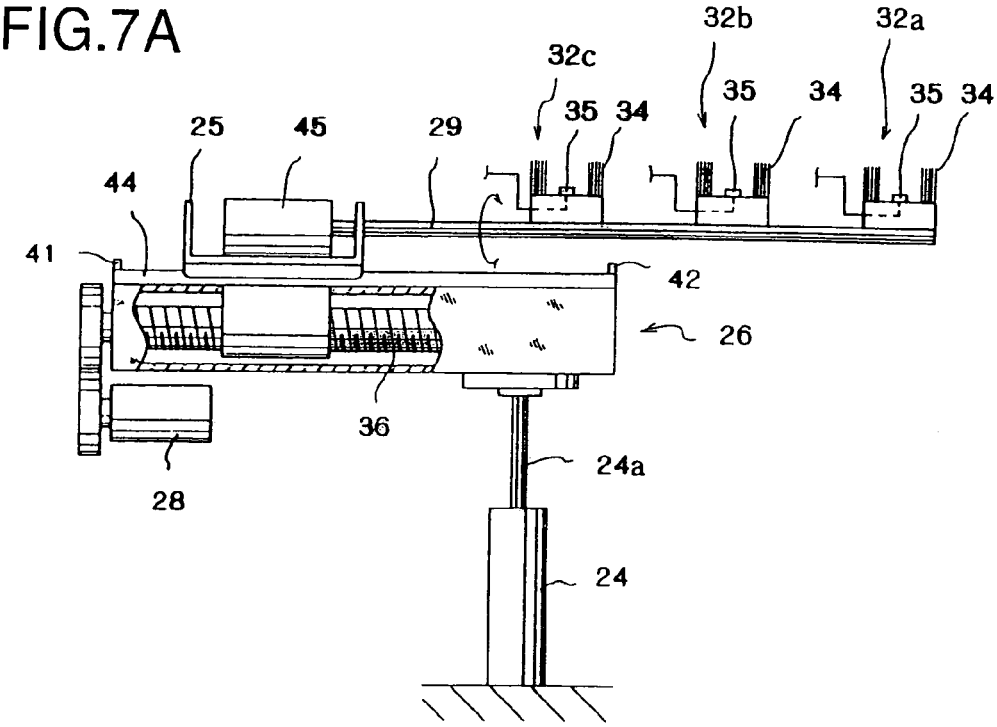
FIGS. 7A and 7B are explanation views of another embodiment of the cleaning device.

This disadvantage can be solved by a cleaning device shown in FIGS. 7A, in which a plurality of the nozzle sections 32*a*, 32*b* and 32*c* are linearly arranged on a shaft 29 with regular separations.

Figure 7B:
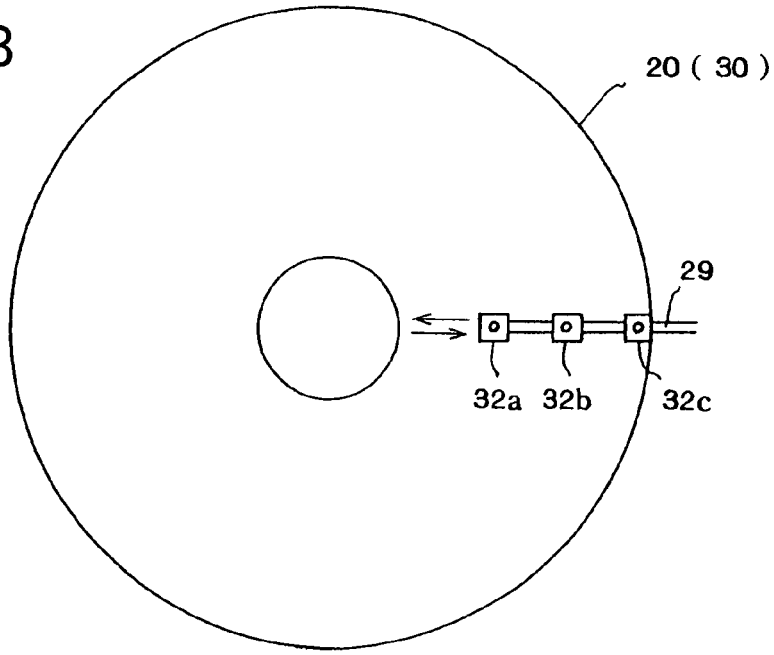

By linearly providing the nozzle sections 32*a*, 32*b* and 32*c* on the shaft 29 with the regular separations, the nozzle section 32*c*, which is located on the motor 45 side, corresponds to the outer edges of the abrasive plates 20 and 30, and the nozzle section 32*a* corresponds to inner portions of the abrasive plates 20 and 30 (see FIG. 7B). Since a plurality of the nozzles 32*a*, 32*b* and 32*c* are linearly arranged on the shaft as shown in FIG. 7A, strokes of the nozzle sections 32*a*, 32*b* and 32*c* can be shorter than the stroke of the nozzle section 32 shown in FIG. 3, in which one nozzle section 32 is provided on the shaft 29. Therefore, working efficiency can be improved.

Since the shaft 29 is turned by the motor 45 together with the nozzle sections 32*a*, 32*b* and 32*c*, the nozzle sections 32*a*, 32*b* and 32*c* can be simultaneously headed to the same direction. Namely, the nozzle sections 32*a*, 32*b* and 32*c* are firstly headed to the lower abrasive face of the upper abrasive plate 20, and the water is simultaneously jetted from the nozzle sections 32*a*, 32*b* and 32*c* so as to clean the lower abrasive face of the upper abrasive plate 20. After the upper abrasive plate 20 is cleaned, the nozzle sections 32*a*, 32*b* and 32*c* are turned and headed to the upper abrasive face of the lower abrasive plate 30, and the water is simultaneously jetted from the nozzle sections 32*a*, 32*b* and 32*c* so as to clean the upper abrasive face of the lower abrasive plate 30.

Note that, in the cleaning device shown in FIG. 7A, structural elements shown in FIG. 3 are assigned the same symbols and explanation is omitted.

Figure 8A:
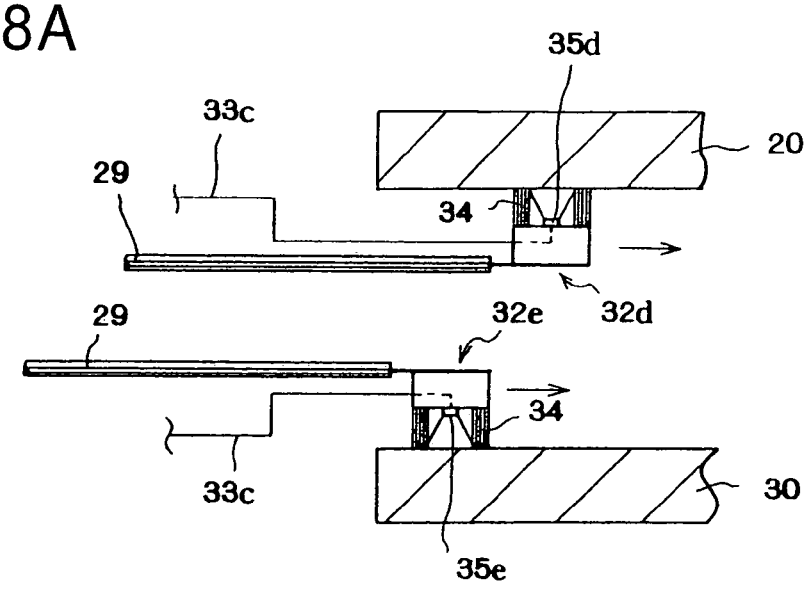
FIGS. 8A and 8B are explanation views of another embodiment of the cleaning device.

The working efficiency of cleaning the abrasive plates can be improved by a cleaning device shown in FIG. 8A, too. The cleaning device includes: a nozzle section 32*d* including a nozzle 35*d* for jetting water toward the lower abrasive face of the upper abrasive plate 20; and a nozzle section 32*e* including a nozzle 35*e* for jetting water toward the upper abrasive face of the lower abrasive plate 30. The nozzle sections 32*d* and 32*e* are independently moved.

If the nozzle sections 32*d* and 32*e* are moved together, the water which has washed the lower abrasive face of the upper abrasive plate 20 falls onto and contaminates the upper abrasive face of the lower abrasive plate 30. To solve the disadvantage, the water falls onto the lower abrasive plate 30 is removed as shown in FIG. 8A. Namely, the movement of the nozzle section 32*e* is a prescribed time behind the movement of the nozzle section 32*d* so as to securely remove the water fallen onto the upper abrasive face of the lower abrasive plate 30, so that the contamination of the lower abrasive plate 30 can be securely prevented.

The nozzle section 32*e* may be provided immediately below the nozzle section 32*d* (see FIG. 8A); the nozzle sections 32*d* and 32*e* may be arranged with a proper separation (see FIG. 8B).

Note that, in FIG. 8A, heading of the nozzle sections 32*e* and 32*e* may be fixed.

Figure 8B:
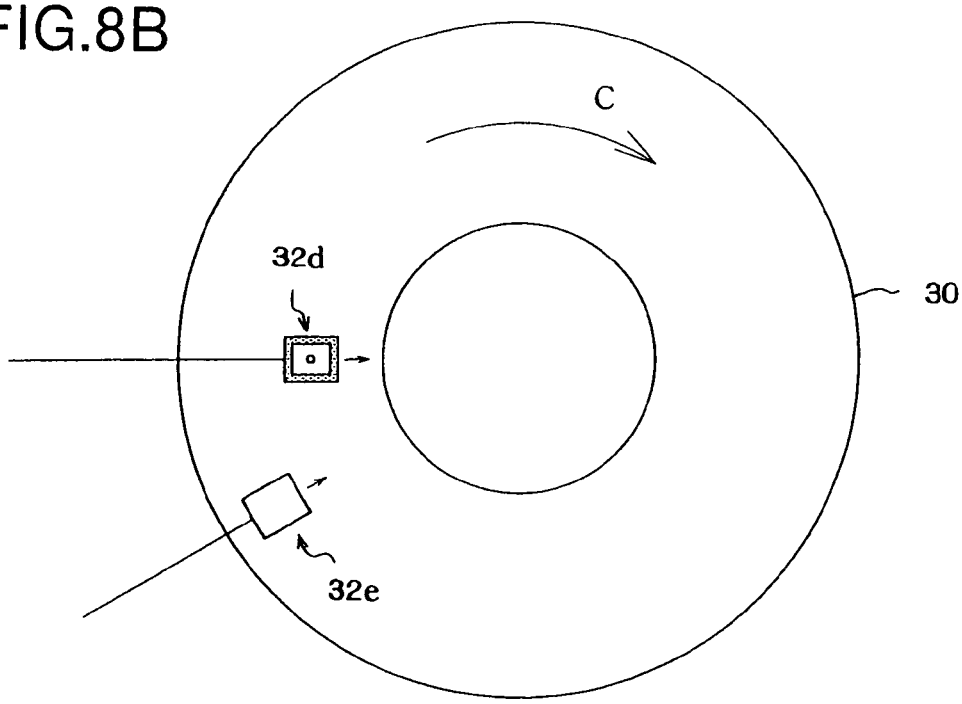

The cleaning devices shown in FIGS. 8A and 8B are separated from the abrasive machine, but they may be assembled in the abrasive machine.

The closing brush 18 may include a nozzle, to which the water is supplied via the hollow shaft 11. By jetting the water from the nozzle, the brush 18 can wash the outer circumferential face of the upper abrasive plate 20. Of course, the brush 18 can close the gap between the outer edge of the upper abrasive plate 20 and the inner edge of the brush 34 of the nozzle section 32, so that scattering the jetted water from the gap can be prevented.

In the cleaning devices shown in FIGS. 1–8B, the brush 18 (the closing means) is provided to the front end of the shaft and moved close to and away from the outer circumferential face of the upper abrasive plate 20.

Figure 9:
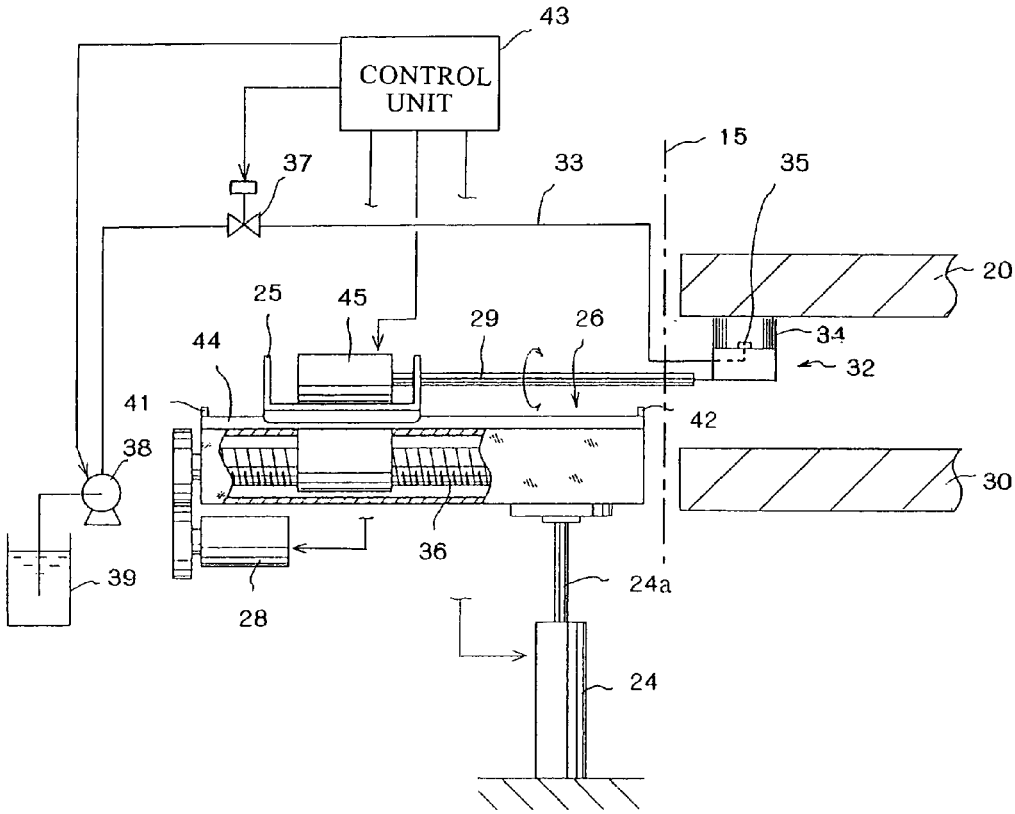
FIG. 9 is an explanation view of another embodiment of the cleaning device.

In a cleaning device shown in FIG. 9, an enclosing member 15 encloses a space including the abrasive plates 20 and 30 and prevents the water, which is jetted from the nozzle 35, from scattering outside. By employing the enclosing member 15, the closing means, e.g., the brush 18, can be omitted.

In the cleaning device shown in FIG. 9, structural elements shown in FIG. 3 are assigned the same symbols and explanation will be omitted.

Further, the structures shown in FIGS. 4A–8B may be employed in the cleaning device shown in FIG. 9. Note that, their explanation will be omitted, too.

In the above described cleaning devices, the brush 34 encloses 35 as the preventing means, but the preventing means is not limited to the brush 34. Net, cloth, etc., which are capable of preventing the water from scattering outside, may be used as the preventing means.

Further, the closing means, which closes the gap formed between the outer edge of the upper abrasive plate 20 and the brush 34 or 102, is also not limited to the brush 18. Net, cloth, etc., which are capable of preventing the water from scattering from the gap, may be used as the closing means.

The above described cleaning devices may be used for cleaning polishing plates of a polishing machine which polishes both side faces of a work piece, e.g., a silicon wafer. In this case too, proper temperature of the water for cleaning the polishing plates is 10–90° C., preferably about 40° C.; proper pressure of the jetted water at an outlet of a pump is 10.79 MPa or more, preferably 11.76 MPa or more.

In the cleaning device of the present invention, the whole abrasive faces of the upper abrasive plate and the lower abrasive plate can be cleaned without scattering the water, which has been jetted toward the abrasive face, into the space in which the abrading mechanism is set.

Even if the abrasive machine is installed in a clean room, no dirty water is scattered into the clean room. Therefore, degree of cleanliness of the clean room can be maintained high. The cleaning device is especially proper for a polishing machine which is installed in a high clean room and polishes silicon wafers.

Further, in the cleaning device of the present invention, the abrasive face of the lower abrasive plate is cleaned after the abrasive face of the upper abrasive plate is cleaned. With this action, the water washing the upper abrasive plate and falling onto the upper abrasive face of the lower abrasive plate can be securely removed when the lower abrasive plate is washed, so that the contamination of the lower abrasive plate can be fully prevented.

Since the upper abrasive plate and the lower abrasive plate are separately cleaned, the moving speed of the nozzle can be easily adjusted on the basis of the width and density of the discharging grooves of each abrasive face. Therefore, the abrasive faces can be fully cleaned.

By fully cleaning the abrasive faces of the abrasive plates, damaging work pieces, which is occurred by abraded dusts, etc. deposited in the abrasive faces, can be securely prevented, and yield of abraded products can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of cleaning abrasive faces of an upper abrasive plate and a lower abrasive plate of an abrasive machine, said upper and lower faces being mutually faced, said method comprising:

providing a cleaning apparatus, said cleaning apparatus including:

a nozzle for jetting water toward the abrasive faces of said abrasive plates rotating;

means for moving said nozzle along the abrasive faces of said upper and lower abrasive plates for cleaning said plates;

means for preventing the jetted water from scattering in the air, said preventing means enclosing said nozzle; and means for closing a gap between said preventing means and an outer edge of said upper abrasive plate, said gap closing means being disposed planar with said outer edge of said upper abrasive plate;

jetting water from said nozzle toward the abrasive face of said upper abrasive plate;

moving said nozzle toward the outer edge of said upper abrasive plate; and moving said gap closing means towards said outer edge of said upper abrasive plate for closing said gap when said gap is formed between said preventing means and the outer edge of said upper abrasive plate.

2. The method according to claim 1, further comprising:

cleaning the abrasive face of said upper abrasive plate by water jetted from a first nozzle; and cleaning the abrasive face of said lower abrasive plate by water jetted from a second nozzle.

3. A method of claim 2, further comprising:

moving said second nozzle at a prescribed time behind that of said first nozzle so as to securely remove the water fallen onto the upper abrasive face of said lower abrasive plate.

4. The method according to claim 1, wherein said nozzle is a rotatable nozzle, said method further comprising rotating said nozzle by rotating means.

5. The method according to claim 1, wherein said preventing means is a brush enclosing said nozzle.

6. The method according to claim 1, wherein said closing means is a brush, said method further comprising moving said brush by actuating means so as to close said gap.

7. The method according to claim 1, further comprising cleaning the abrasive face of said lower abrasive plate after the abrasive face of said upper abrasive plate is cleaned.

8. The method according to claim 1, further comprising supplying pressure of water to said nozzle at 10.79 MPa or more.

* * * * *